US005086700A

United States Patent [19]

Van Den Berg

[11] Patent Number: 5,086,700

[45] Date of Patent: Feb. 11, 1992

[54] DRYING/CURING APPARATUS FOR PRINTING PRESSES

[76] Inventor: Eduard Van Den Berg, 990 St. Paul Dr., Cincinnati, Ohio 45206

[21] Appl. No.: 579,471

[22] Filed: Sep. 10, 1990

[51] Int. Cl.[5] ..... B41F 35/00

[52] U.S. Cl. ..... 101/424.1; 101/416.1; 34/7

[58] Field of Search ..... 101/416.1, 424.1, 487; 34/4, 40, 41, 7

[56] References Cited

U.S. PATENT DOCUMENTS 3,108,863 10/1963 Limberger et al. ..... 34/7
3,831,289 8/1974 Knight ..... 34/7
4,037,329 7/1977 Wallace ..... 34/7
4,257,172 3/1981 Townsend ..... 34/39

FOREIGN PATENT DOCUMENTS 726188 3/1955 United Kingdom ..... 34/41

*Primary Examiner*—Edgar S. Burr
*Assistant Examiner*—Ren Yan
*Attorney, Agent, or Firm*—Kinney & Schenk

[57] ABSTRACT

Drying/curing apparatus comprises a hot air dryer and a radiation unit for drying water based inks or irradiating ultra violet radiation curable inks printed on a web traveling therepast. A laterally displaceable shutter is interposed between the web and the radiation unit when movement of the web is halted.

1 Claim, 3 Drawing Sheets

DRYING/CURING APPARATUS FOR PRINTING PRESSES

The present invention relates to improvements in drying/curing apparatus for printing presses and more particularly to drying/curing apparatus incorporating ultra violet curing means.

There are two classes of printing inks which require distinctive mechanisms to be dried, after being printed in a liquid state.

The more familiar class is that in which drying is accomplished by evaporation of a water or hydrocarbon based carrier. In a rotary type press, having a continuously moving web, the ink, printed on the web, is dried by directing heated air against the printed surface of the web, at a point downstream of the printing head of the press.

In the second class of printing inks, the ink is converted to a solid form by a curing process which is attained by exposure of the printed ink to ultra violet radiation. In rotary presses, an ultra-violet light is mounted to direct radiation on the printed ink, downstream of the printing head.

The rate of feed of a printed web can be quite high, as much as 1,000 feet per minute, or more. The time for which the web is exposed to a dryer, or ultra violet light is thus relatively short. This leads to the use of high energy/high temperature dryers and ultra violet lights.

Duration of exposure to heated air can be increased by increasing the lineal length of the hot air dryer field. Duration to exposure to ultra violet radiation can be increased by the use of a plurality of ultra violet lights. These options are limited by practical considerations. This is to say that there is a practical limit to the length of curing/drying zone for the printed web. Thus, it is a prime concern to minimize the length of the curing/drying zone.

The use of high energy curing/drying means poses a problem and a potential hazard when movement of the web is interrupted and it is brought to a halt. This is particularly applicable to the ultra violet light radiation unit. While ultra violet light curable inks are essentially non-responsive to heat energy in their curing process, there is an extremely high level of heat energy created by ultra violet lamps. This level of heat energy is sufficient to damage a printed web (usually a paper web) in a relatively short time, and can cause ignition of the web when there is uninterrupted radiation on a stationary web for any substantial length of time.

This problem is most frequently encountered in setting up a rotary press for a production run. The set up process involves frequent starting and stopping of the press as adjustments are made for such factors as proper registration of printed copy and the proper density of ink application.

The obvious expedient of deenergizing the ultra violet lamp is impractical because of the length of time required for energization and deenergization of such lamps.

One accepted solution to this problem has been the provision of pivoted shutters which swing from a blocking position, when the web is brought to a halt, to an position permitting radiation to impinge the web when it is moving. These shutters are mounted at the top and bottom of the lamp reflector, each having a height half the height of the reflector opening. This solution has inherent disadvantages. Where the shutters are swung away from the web, toward the ultra violet lamp, they interfere with the reflector which focuses the energy of the lamp on the web. Where the half shutters swing towards the web, their height requires the radiation unit to be spaced from the web a distance greater than the optimal distance for such spacing and/or unduly increases the lineal length required for the radiation unit.

In many printing operations it is desired to use air dryable or ultra violet light curable inks on an interchangeable basis, dependent on the desired characteristics of a given print job. Thus it is desirable that a printing press have the capability of drying water and hydrocarbon based inks, as well as curing ultra violet light curable inks.

The availability of printing presses have such dual capability, has, in the past, been limited by lack of a suitable solution to the problem of damage to the web, and potential fire hazards, from the radiation unit, when movement of the web is interrupted.

Accordingly, the primary object of the present invention is to provide improved means for preventing radiation from an ultra violet lamp from impinging on a printed web, when feeding of the web is interrupted and a portion thereof is stationary with respect to the lamp.

A related object of the present invention is provide a more compact printing press having the capability drying/curing printing inks by either hot air or by means of ultra violet radiation.

A further object of the present invention is to facilitate the provision of a plurality of ultra violet light lamps in the curing of ink printed on a web, in a rotary printing press.

The foregoing ends are attained by a print module comprising a printing head for imprinting ink on a web of printable material moving therepast and drying/curing apparatus disposed downstream of the printing head. The drying/curing apparatus comprises a hot air dryer for directing hot air against the printed surface of the web as it moves therepast and a radiation unit for directing ultra violet radiation against the web as it moves therepast through a given length of travel. Shutter means are provided for blocking radiation from the web when movement of the web is halted.

The shutter means are characterized by a shutter plate disposed in a plane generally parallel to the path of travel of the web past the radiation unit and have a height at least as great as the length of travel to which the web is exposed to radiation from the radiation unit. The shutter means also include means for displacing the shutter plate between a "print" position permitting the web to be exposed to radiation and a blocking position in which the shutter plate is disposed between the web and the radiation unit and blocks radiation from the web.

The print module may comprise means defining a downward, vertical path of travel of the web past the hot air dryer and radiation unit. The shutter means may be further characterized in that the "print" position of the panel is to one side of the path of travel of the web. Additionally, the shutter means may be further characterized by means for guiding the shutter plate in a rectilinear path of travel between its "print" position and its blocking position. A preferred feature is found in the provision of an air motor for displacing the shutter plate between its "print" and blocking positions.

The drying/curing apparatus may comprise a pair of vertical side frame plates on which the hot air dryer and the radiation unit are mounted. The shutter means are then further characterized by one of the side frame plates having an opening through which the shutter plate passes in being displaced between its "print" and blocking positions. The means guiding the shutter plate for rectilinear movement may then comprise a pair of grooved rails disposed adjacent the top and bottom of the shutter plate and extending between the side frame plates and outwardly of the side frame plate in which the opening is formed. Rollers, mounted on the shutter plate, ride in the grooved rails to guide movement of the shutter plate.

A further feature of the invention is found in the provision of a second radiation unit, adjacent the first mentioned unit. The shutter plate is then provided with a height sufficient to block radiation from the web when its movement is halted. Economies are found in using a single air motor to displace this shutter plate between the "print" position and the blocking position in which the web is protected from radiation from both radiation units, when movement of the web is interrupted.

The described features of the curing unit may also be incorporated in a separate curing unit, with or without a hot air dryer, which is adapted to be used in combination with a printing head.

The above and other related objects and features of the invention will be apparent from a reading of the following description of a preferred embodiment thereof, with reference to the accompanying drawings and the novelty thereof pointed out in the appended claims.

IN THE DRAWINGS

Figure 1:
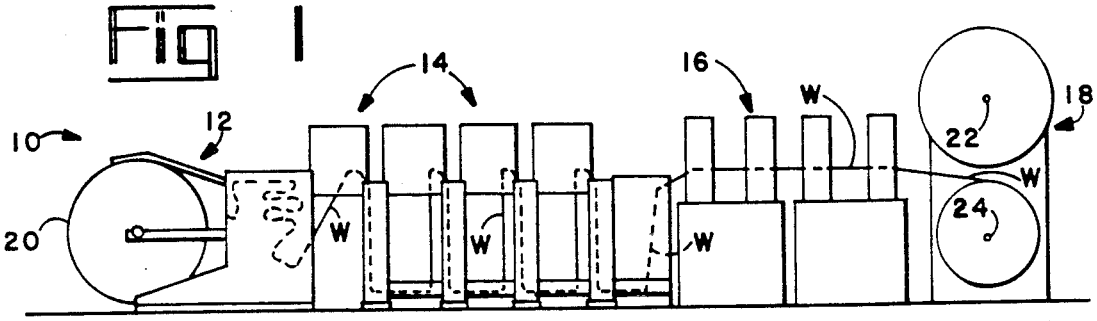
FIG. 1 is an elevation of a printing press in which the present invention is incorporated.

For illustrative purposes, the drying/curing apparatus of the present invention is shown as it would be incorporated in a printing press, generally indicated by reference character 10, employed in the production of labels, reference FIG. 1.

The printing press 10 comprises an unwind module 12, a plurality of printing modules 14, a plurality of die cutting modules 16 and a rewind module 18. A supply roll 20 of stock material is mounted at the unwind module 12. The stock material may comprise a strip of label material having a layer of adhesive adhered thereto and a strip of liner material which is releasably adhered to the strip of label material. A web W is drawn from the supply roll 20, passes through a tensioning mechanism and then to the first of the printing modules 12, sequentially through the several printing modules to and through the several die cutting modules and then is wound on one or the other of the shafts 22, 24 of the rewind station 18.

As the web passes through the print stations 14, the web W is imprinted with solid colors or with copy, as desired. The web is then die cut or perforated to define the configuration of individual labels by one or more of the die cutting modules 16. The web is then wound in roll form at the rewind station 18 for further processing in accordance with customary practices of the trade.

Figure 2:
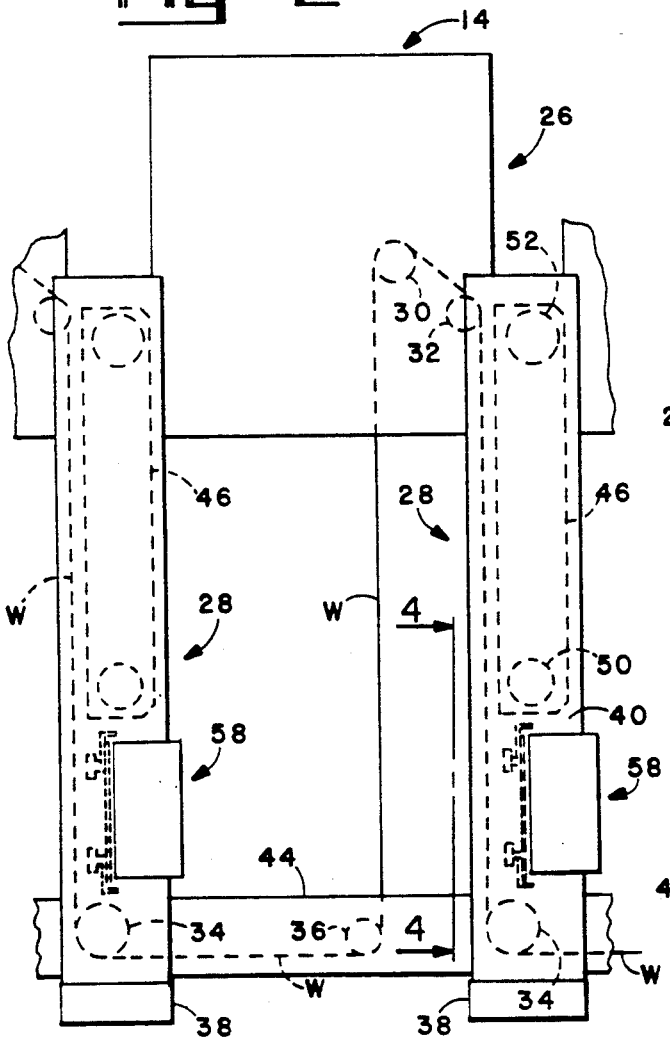
FIG. 2 is an elevation, on an enlarged scale, of a printing module seen in FIG. 1.
Figure 3:
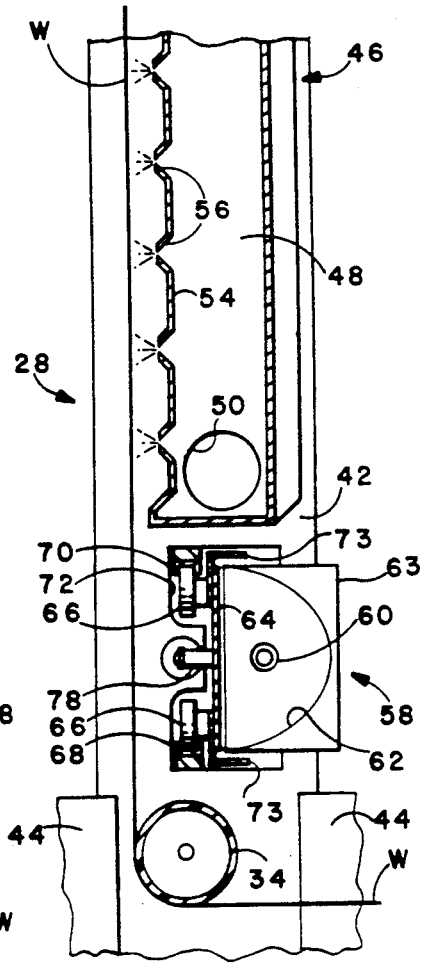
FIG. 3 is an elevation, in section and on an enlarged scale, of drying/curing apparatus seen in FIG. 2 (reference line 3—3 in FIG. 4)

Reference is next made to FIG. 2, which shows a printing module 14 in greater detail. Each module 14 comprises a printing head 26 and drying/curing apparatus 28. The printing head includes means for printing a solid color or copy on the web W. Various printing means are known in the art and the means employed form no part of the present invention, and, therefore are not illustrated. The only component of the printing head 14 which is illustrated is a roll 30 which guides the web W through the printing head and may be a powered, impression roll therefor.

The web W passes from roll 30 to an upper, exit guide roll 32 rotatably mounted in the printing head 26. A second guide roll 34 rotatably mounted at the lower end of the drying/curing apparatus 28, defines a vertical path of movement for the web W through the drying/curing apparatus 28. From the drying/curing apparatus 28, the web W passes to a guide roll 36 and then to the next succeeding printing module 14, or to the first of the die cutting modules.

It will be briefly noted that the infeed end of the printing head of each print module 14 is supported by the drying/curing apparatus 28 of the preceding print module, with the infeed end of the printing head 28 of the first print module being supported on the unwind module 12. More specifically, each drying/curing apparatus 28 comprises a base plate 38 (see also FIG. 4) and a pair of vertical side frames 40, 42. The guide roll 34 is mounted on a shaft which extends between the frame plates 40, 42. It will also be seen the infeed guide rolls 36 extend between and are mounted on bars 44, which interconnect adjacent side frames 40, 42.

The drying/curing apparatus 28 comprises a hot air dryer 46 which may take different forms. As illustrated, the dryer 46 comprises a plenum chamber 48 extending between and secured to the side frames 40, 42. The plenum chamber 48 is connected to a source of pressurized hot air by a conduit 50, at its lower end, with an exhaust conduit 52 being connected to its upper end. The plenum 48 is defined by a sheet metal panel 54 disposed in a vertical plane parallel to the web W as it travels from the guide roll 32 to the guide roll 34. The sheet metal panel has a plurality of horizontal slots 56 defined by angled portions of the panel 54 and providing a plurality of nozzles for directing hot air against the web W as it travels therepast.

An ultra violet radiation unit 58 is disposed beneath the hot dryer 46, extending between and being mounted on the side frames 40, 42. The radiation unit 58 comprises a horizontally disposed ultra violet light tube 60 which is mounted, in known fashion for connection to an energization source. The tube is mounted in parallel relation to the web W and has a length approximating the width of the web W. A parabolic reflector 62 is disposed behind the tube 60 to focus the ultra violet radiation against the web W as it travels therepast.

The radiation unit 58 may be, and is illustrated as, a commercially available irradiator, as is available from Canrad-Hanovia, Inc., Newark, N.J. For the sake of simplicity, several components of the radiation unit 58 have been omitted from the drawings. Thus a housing 63 is shown for the reflector 62. This housing, through intermediate components, not shown, provide for mounting of the radiation unit 58 on the frames 40, 42. The omitted components also provide for electrical connections to the lamp to provide for its energization. Also, the omitted components provide cooling air which minimizes the operating temperatures of the radiation unit. The mounting, energization and cooling functions are well understood by those skilled in the art and, therefore, are not described herein.

The curing effectiveness of the ultra violet light is a function of its intensity. Thus, where radiation is focused on a small surface, faster curing is obtained, than if the same radiation is distributed over a relatively large surface. This explains the preferred use a radiation unit having a parabolic (or elliptical) reflector which focuses radiation from the lamp 60 on the web W. Several factors can control the focal length for the reflector of a given radiation unit.

The point to be recognized is that these factors can dictated a relatively short focal length, which, in turn requires that the radiation unit must be mounted in closely spaced relation from the printed web. As will be seen from the following description, the present invention accomplishes the desired end of blocking radiation from the web (when it is stationary), where the radiation unit is closely spaced from the web. "Closely spaced" as used in the present context, is intended to reference a spacing less than half the height of the opening of the reflector 62.

Cooperating with the dryer 46 and the radiation unit 58, which are, per se, known, is a shutter 64. The shutter is selectively displaced from a "print" position (FIG. 4) in which radiation from the tube 60 the web W and a blocking position (FIG. 5) in which this radiation is blocked from the web, when the web is not moving.

The shutter 64 is a thin, light weight plate, advantageously formed of aluminum, having a width which is at least as great as that of the web W and a height sufficient to block radiation radiating outwardly from the reflector 62. Rollers 66 are mounted on the corners of the shutter 64. The rollers on the lower corners of the shutter 64 ride in grooves formed in a supporting rail 68, which extends between the frame plates 40, 42 and extends outwardly of the frame plate 42. The rollers 66, on the upper corners of the shutter 64, ride in grooves formed in a guide rail 70, which also extends between the frame plates 40, 42 and extends outwardly of the frame plate 42. An opening 72 is formed in the frame plate 42 to permit the rails 68, 70, as well as the shutter 64 to pass therethrough.

Additionally, angles 73 may be secured to the top and bottom edges of the shutter plate 64. These angles project toward the deflector 62, beyond the opening thereof and further block radiation energy from reaching the web W when its movement is interrupted.

Movement of the shutter 64 is controlled by an actuator in the form of a linear air motor (air cylinder) 74, the cylinder of which is mounted on and extends outwardly from the frame plate 42. The control rod 76 of the actuator 74 is connected to the shutter 64 through a pin 78 which projects therefrom, intermediate its height. Pressurized air is selectively directed to opposite ends of the actuator 74, through hoses 80, 82 to displace the shutter between its "print" and blocking positions.

Figure 4:
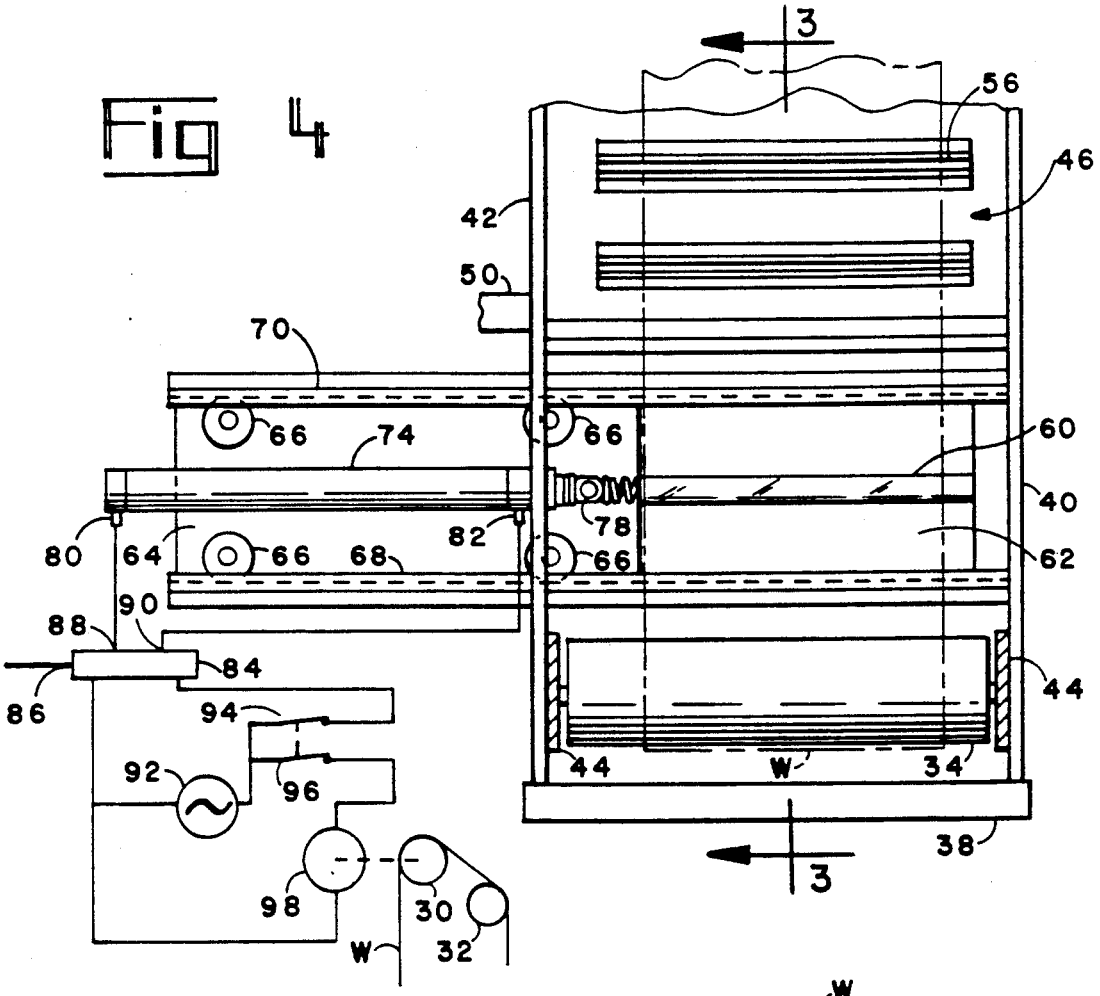
FIG. 4 is a view taken on line 4—4 in FIG. 2, with a control circuit being diagrammatically shown therewith.

A simplified circuit for coordinating the position of the shutter 64 with feeding of the web W is diagrammatically shown in FIG. 4. A solenoid controlled valve 84 is connected to a source of pressurized air through a port 86, with the hoses 80, 82 connected to outlet ports 88, 90 of the valve 84. The solenoid coil of the valve 84 is connected across an appropriate power source 92 through a switch 94. A ganged switch 96 connects a drive motor 98 across the power source 92. The motor 98 powers the means which advance the web W through the printing press, this being, illustratively, shown by a mechanical connection to one of the print head rolls 30. Thus in the "print" position, illustrated in FIG. 4, the motor 98 is energized to advance the web W and the valve 84 directs pressurized air to the hose 82 to position the shutter 64 in a retracted position, wherein radiation is directed against the web W as it moves past the radiation unit 58. When it is desired to stop the printing operation and halt movement of the web W, the ganged switches 94, 96 are opened. The motor 98 is deenergized and the coil of solenoid valve 84 is deenergized, causing pressurized air to be directed to the hose 80 and thereby extending the rod 76 and displacing the shutter 64 to a position in which radiation is blocked from the web W.

An additional feature of the invention is found in the provision of shock absorbing means for limiting travel of the shutter plate 64 (FIGS. 4, 5 and 7, 8). The outer end of the rod 76 has a flattened end portion 100, which has an opening for receiving the pin 78 and providing the connection with the shutter plate 64. A spring 102 is mounted on a boss 104 which projects from the flat portion 100. A second spring 106 is telescoped over the rod 76 and may be secured to the opposite side of the flat portion 100.

Figure 5:
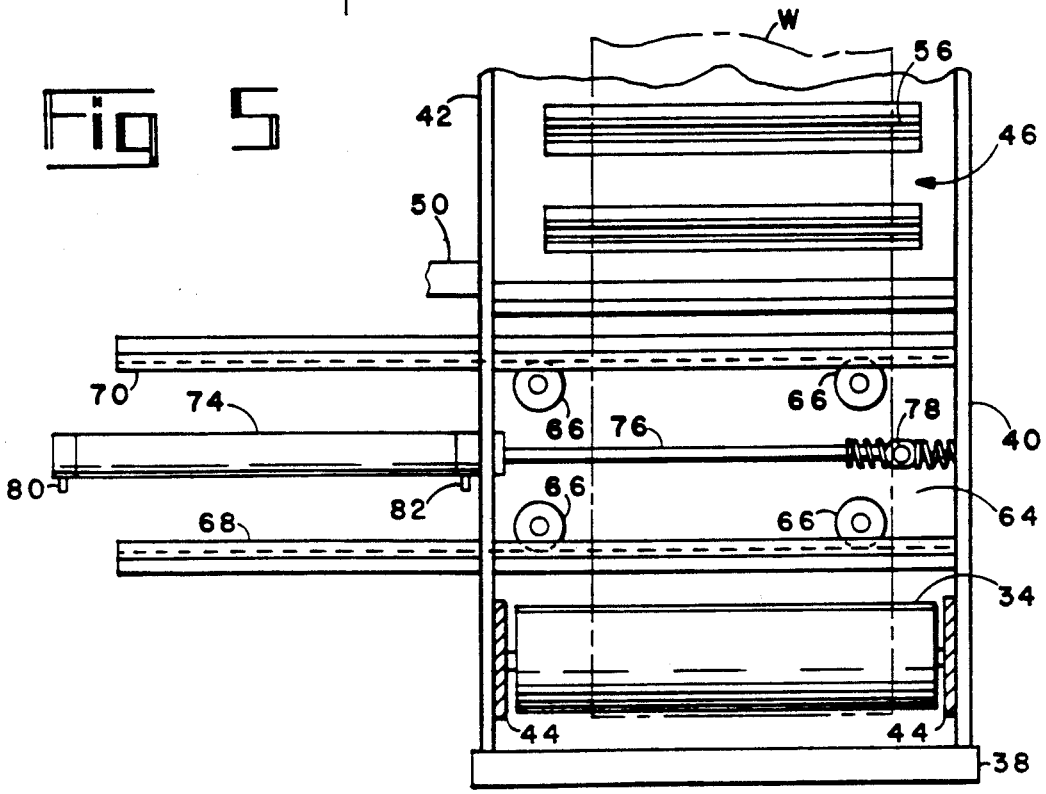
FIG. 5 is a view similar to FIG. 4, illustrating shutter means therein, in a protective position.
Figure 8:
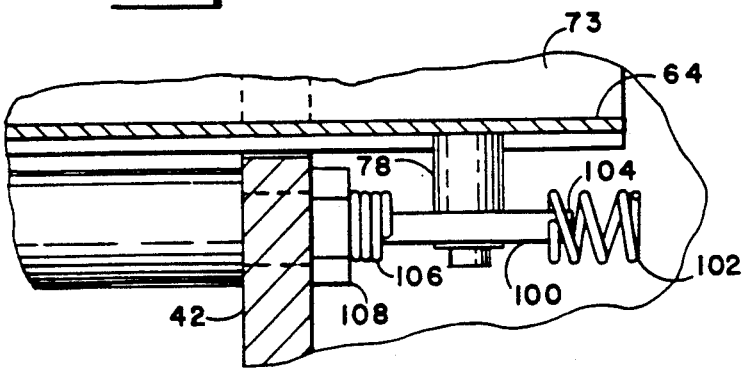
FIG. 8 is a view similar to FIG. 7, illustrating the shutter plate in its retracted, "print" position.

When the air motor 74 is actuated to extend the rod 76 and move the shutter plate 64 to its blocking position seen in FIGS. 5 and 8, the spring 102 is compressed against the side frame 40. Similarly, when the air motor 74 is actuated to retract the shutter plate 64 to its "print" position, The spring 106 is compressed against a nut 108, which is employed in mounting the air motor 74 on the frame 42. The springs 102 and 106 thus absorb shock loadings which would otherwise be generated if movement of the shutter were limited by bottoming of the air motor piston against the ends of its cylinder, or by direct engagement of the shutter with the frame members.

Figure 6:
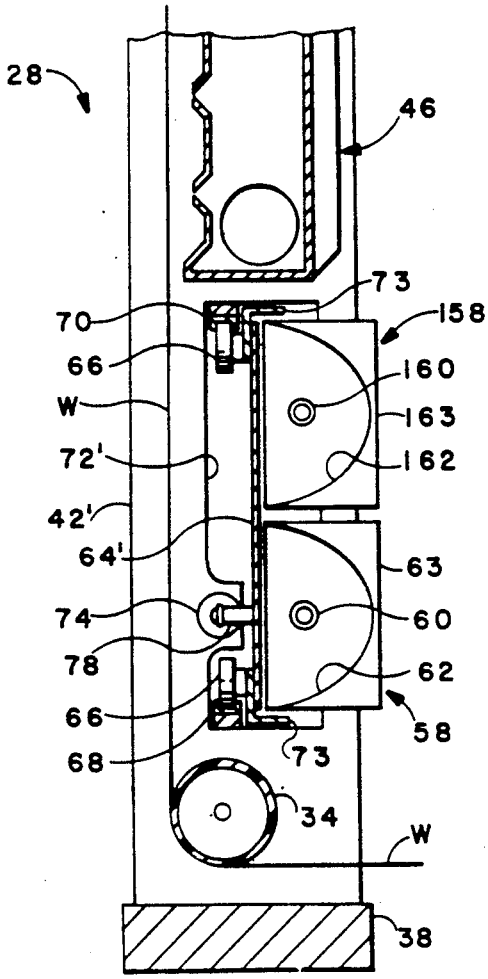
FIG. 6 is a view similar to FIG. 3 illustrating an alternate embodiment of the invention.
Figure 7:
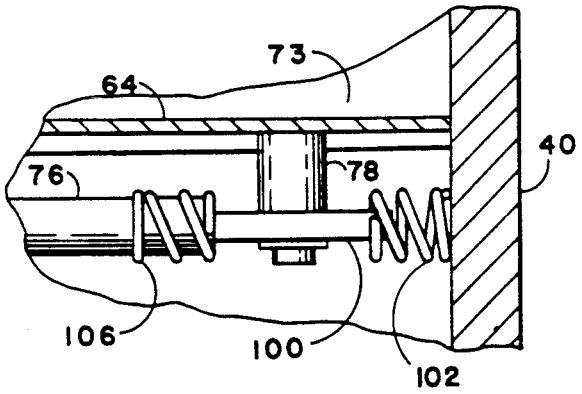
FIG. 7 is a plan view, on an enlarged scale and in section, of the connection between a shutter plate and the actuator rod of a air motor, illustrating the shutter plate in its extended, blocking position.

Reference is next made to FIG. 6, which illustrates a drying/curing apparatus 28' which comprises a second radiation unit 158, disposed above the first radiation unit 58. The second radiation unit 158 may be identical with the radiation unit 58 and mounted on frames, 40, 42' in the same relation to the web W, as previously described. The radiation unit 158 thus comprises a lamp 160, a reflector 162 and a housing 163.

A shutter plate 64' is provided to perform the same function as the plate 64 in preventing the web W from being damaged when its movement is interrupted. The shutter plate 64' may be identical with the shutter plate 64, except that its height has been increased so that, in its blocking position, it is interposed between the outlet openings of both the reflector 62 and the reflector 162 of the radiation units 58 and 158.

The shutter plate 64' is guided for lateral movement in the same fashion as the shutter plate 64 by rails 68 and 70 which extend between the side frames 40, 42' and outwardly of the latter side frame. The side frame 42' is modified to provide a larger opening 72' for passage of the larger shutter 64' therethrough. Additionally, the rail 70 has been raised to receive rollers 66 which are relocated to the top portion of the shutter plate 64'.

The shutter plate 64' is connected to and displaced by the air motor 74 in the same fashion as described in connection with the shutter plate 64.

The lineal length of the dryer 46 may be adjusted to accommodate the increased, combined lineal length of the two radiation units. This increase in lineal length is minimized by the close vertical spacing which can be achieved between the two radiation units.

It will be apparent that the present means for protecting the web from radiation when its movement is interrupted, additionally, facilitates the use of a plurality of radiation units in a minimum lineal length of web travel and without requiring additional components to attain such end.

The foregoing describes operation of the press where inks, which are curable by ultra violet light are being printed. In such case, the hot air dryer 46 may be deactuated by provision appropriate means. Similarly, if water or hydrocarbon based inks are being printed, separate means may be provided for controlling the radiation unit so that it remains inoperative while the hot air dryer is in operation. In such case, the shutter can remain in either its retracted or blocking position and appropriate means provided for either deactuating the valve 84 or connection with a source of pressurized air shut down.

It will be appreciated that the laterally displaceable shutter 64 requires a minimal length of web travel. This is to say that the radiation unit has a given height which provides a radiation field effective on a given length of web travel. The shutter mechanism of the present invention requires little or no additional length to be incorporated in the drying/curing apparatus 28.

The minimal length requirements of the present shutter mechanism enable the provision of both hot air drying means and radiation curing means in a single, vertical run of the web W, while enabling the printing head to be positioned at a height where such operational procedures as changing printing plates can be conveniently performed by a workman standing on the floor on which the press is mounted.

It will also be appreciated that the present shutter control mechanism is highly reliable, as well as being economical to manufacture. Thus it may be advantageously employed in printing modules which are intended for use only with inks that are curable by ultra violet radiation. It will be further appreciated that the compact shutter mechanism of the present invention facilitates the use of multiple radiation units mounted in series fashion along the path of travel of the web. Thus the drying/curing apparatus could comprise two or three radiation units 58 in combination with a hot air dryer 46 within a vertical path of travel which permits operational procedures to be conveniently performed, as exemplified by the embodiment of FIG. 6.

The drying/curing apparatus has been shown as it would be used in a label printing press (10) for illustrative purposes, but finds utility in any type of press. Further the drying/curing apparatus may be adapted to be separately provided for use with existing printing heads, or printing heads of different designs.

The above and other variations from the from the described, preferred embodiments will occur to those skilled in the art, within the spirit and scope of the present inventive concepts, as defined in the following claims.

Having thus described the invention, what is claimed as novel and desired to be secured by Letters Patent of the United States is:

1. A print module comprising a pair of vertical side frame plates, a printing head for imprinting ink on a web of printable material moving therepast, and drying/curing apparatus disposed downstream of the printing head and comprising a hot air dryer, mounted on the side frame plates, for directing hot air against the printed surface of the web as it moves therepast, and a radiation unit, mounted on the side frame plates, for directing ultra violet radiation against the web as it moves therepast through a given length of travel, means defining a downward, vertical path of travel of the web past the hot air dryer and radiation unit, and shutter means for blocking radiation from the web when movement of the web is halted, characterized in that the shutter means comprise a shutter plate disposed in a plane generally parallel to the path of travel of the web past the radiation unit, and having a height at least as great as the length of travel to which the web is exposed to radiation from the radiation unit, and an air motor for displacing said shutter plate between a "print" position permitting the web to be exposed to radiation and a blocking position in which the shutter plate is disposed between the web and the radiation unit and blocks radiation from the web, one of the side frame plates having an opening through which the shutter plate passes in being displaced between said "print" and blocking positions, said "print" position of the shutter plate being laterally to one side of the path of travel of the web, means for guiding said shutter plate in a rectilinear path of travel between said "print" position and said blocking position, said means guiding the shutter plate for rectilinear movement comprising a pair of grooved rails disposed adjacent the top and bottom of said shutter plate and extending between said side frame plates and outwardly of the side frame plate in which said opening is formed, and rollers, mounted on said shutter plate and riding in said grooved rails, said air motor comprising a cylinder mounted on and extending outwardly from the side frame plate in which said opening is formed, and a rod projecting through said side frame plate and connected to the shutter plate at a point between the side frame plates, said rod displacing the shutter plate in an extended position thereof and displacing the shutter plate to its "print" position in a retracted position thereof, and the air motor rod connection with the shutter plate is disposed adjacent the other of said side frame plates in the blocking position of the shutter plate and is disposed adjacent said one side frame plate in the "print" position of the shutter plate, further characterized by first shock absorbing means mounted on said connection and engageable with said other side frame plate when the rod displaced to its extended position, and second shock absorbing means mounted on said connection for minimizing shock when the rod is displaced to its retracted position.

* * * * *